US006854379B2

(12) United States Patent
Pattle et al.

(10) Patent No.: US 6,854,379 B2
(45) Date of Patent: Feb. 15, 2005

(54) RAIL SYSTEM FOR FOOD SUPPORTS IN A BAKING OVEN

(75) Inventors: Steven Pattle, East Hunsbury (GB); Markus Geberzahn, Hadamar (DE)

(73) Assignee: Accuride International GmbH, Diez (DE)

( * ) Notice: Subject to any disclaimer, the term of this patent is extended or adjusted under 35 U.S.C. 154(b) by 89 days.

(21) Appl. No.: 10/279,459

(22) Filed: Oct. 24, 2002

(65) Prior Publication Data

US 2003/0079615 A1 May 1, 2003

(30) Foreign Application Priority Data

Oct. 24, 2001 (DE) ..... 101 51 899

(51) Int. Cl.[7] ..... F24C 15/16
(52) U.S. Cl. ..... 99/393; 99/450; 126/337 A; 126/339
(58) Field of Search ..... 99/393, 390, 450; 126/337 A, 337 R, 339; 211/153, 162; 248/420, 429; 312/330.1, 332

(56) References Cited

U.S. PATENT DOCUMENTS 2,011,189 A * 8/1935 Anderson ..... 126/339
2,033,860 A * 3/1936 Otte ..... 312/408
2,098,198 A * 11/1937 Sindelar ..... 108/143

FOREIGN PATENT DOCUMENTS

| | | |
|---|---|---|
| DE | 2036 930 | 2/1972 |
| DE | 2238 553 | 8/1972 |
| DE | 74 12 673 | 10/1975 |
| DE | 36 28 763 C2 | 3/1988 |
| DE | 100 51 153 A1 | 4/2002 |

* cited by examiner

*Primary Examiner*—Reginald L. Alexander
(74) *Attorney, Agent, or Firm*—Howard M. Ellis

(57) ABSTRACT

A rail system for food supports in a baking oven provides for a construction which can be fabricated economically, and possesses improved features, including the ability to pull out the food support from the oven, or even to in front of the oven, in a stable, easily slidable manner without tipping. The device includes telescopic rails which are adaptable for positioning outside an oven muffle for longer, more dependable operation and life expectancy by avoiding constantly high oven temperatures, exposure to food and spattering fats or other evaporating liquids.

19 Claims, 3 Drawing Sheets

RAIL SYSTEM FOR FOOD SUPPORTS IN A BAKING OVEN

TECHNICAL FIELD

The present invention relates to a novel rail system for food supports in a baking oven.

BACKGROUND OF THE INVENTION

For the purposes of this invention, the term "food supports" refers to all slide-in elements which are customarily used in baking ovens, such as baking sheets, shelves, baking trays, drip pans, etc.

Furthermore, according to the invention, the term "food supports" is understood as meaning securing devices for aforementioned oven slide-in elements, such as for example frames into which such slide-in elements can be inserted or onto which they can be placed. For the purposes of the invention, a food support consequently does not necessarily have to have a resting surface for the actual food but may also serve simply for fastening or holding such a supporting surface, such as a baking sheet.

The terms "front" and "rear" used here with respect to the baking oven, the food support or telescopic guides refer to a region which, in the case of the oven, is directed toward the opening of the oven (front) or toward the rear side of the oven. A customary baking oven comprises a housing with oven outer walls and a muffle arranged in it with muffle side walls, upper and lower muffle walls and a muffle rear wall, the space inside the muffle representing the actual cooking space of the oven.

Extraction systems for food supports in a baking oven are known in a wide variety of forms and are constantly undergoing further development and improvement. In the case of simple known baking ovens, the food support is guided in grooves which are formed at various heights or levels in the muffle side wall. The sliding behavior of the food supports in such grooves depends on the surface finish of the areas sliding on one another, and the loading of the food support, and is comparatively poor. In the case of other systems, instead of grooves there are grids attached to the muffle side walls with horizontal bars, on which the food supports are guided. On account of the smaller supporting surface, here the sliding behavior is somewhat improved in comparison with grooves. Both systems have the disadvantage that the food support can only be pulled out of the oven to a certain extent without tipping downward or having to be supported at the front. Although the upper groove limitations, or further horizontal grid bars provided a small distance above the food support can support the food support, preventing it from tipping, to a certain pulled-out extent, and so make it possible for it to be pulled out somewhat further, it is not possible in the case of such arrangements for the food support to be pulled out completely, to bring it in front of the muffle, without the food support having to be held by a person.

In the case of improved baking ovens, telescopic guides with in each case a stationary rail and one or more movable rails, which are mounted such that they can slide in the longitudinal direction in relation to the stationary rail and out of the oven, are provided on the muffle side wall or on a grid. A food support can be placed onto the movable rails, so that the food support can be pulled out of the oven by pulling out the telescopic guides. Furthermore, there is a known system with telescopic guides in which the food support resting on the movable telescopic guide rail can, after the movable rail has been pulled out fully as far as it will go, be pulled by a further distance, sliding on the rail, to bring it in front of the oven muffle. This allows the use of telescopic guides with only two rails, which is advantageous for cost reasons. A disadvantage is that it is absolutely necessary in the case of this system for the telescopic rails to be fastened to the side wall in the hot inner region of the oven muffle, in order that the food support can be placed onto the movable rail of the telescopic guide. On account of this mounting of the telescopic guides in the oven muffle, they are easily soiled by food, spattering or evaporating fat or other liquids. These soiling particles are deposited not only on the outer sides of the telescopic rails but also in their interior, to which access is difficult. Cleaning the interior of the telescopic guides, in particular cleaning the bearings, is virtually impossible, or only by placing the entire telescopic guides into a cleaning liquid or by pyrolytic cleaning at very high temperatures. In such cleaning, however, lubricating or sliding agent present in the bearings is in turn likewise removed at the same time, so that in this way the telescopic guides lose their good sliding properties after they have been cleaned a number of times.

A general advantage of telescopic guides in comparison with mounting of the food support in grooves or on wires of a framework is their smooth action, stability and security with respect to tipping of the food support when in a pulled-out position.

SUMMARY OF THE INVENTION

The object of the present invention is to provide an improved rail system for food supports in a baking oven which allows construction of the food support that can be produced inexpensively and permits pulling out the food support from the oven, or even to the front of the oven in a stable, easily sliding manner and without tipping of the food support. With the present invention the telescopic rails can be arranged in such a way that they are protected to the greatest extent from being soiled with food and spattering or evaporating fat or other liquids.

The object is achieved by a rail system for food supports in a baking oven with a food support which has on each of both sides holding brackets connected in the front portion of the food support to the food support by means of a connecting portion of a substantially U-shaped form and extends substantially parallel to the respective side edges of the food support. With telescopic rails having in each case a stationary rail, fastened inside or outside the side wall of the oven muffle and an inner rail which can be displaced in relation to the stationary rail out of the oven. A receiving tube extends substantially over the length of the inner rail and forms a unit with the latter being provided on the inner rail, open toward the opening of the oven and designed for receiving a holding bracket by pushing in, and with the holding bracket and the receiving tube having a hook and a catch for bringing the holding bracket and the receiving tube into a releasable engagement, preventing the holding bracket from sliding out of the receiving tube.

As already stated above, the food support according to the invention may be a baking sheet, a baking shelf, a baking tray, etc., to which the holding brackets are fastened in the front portion of the food support, facing the opening of the oven, by means of a connecting portion formed in a U-shaped manner. The actual support for the food and the two holding brackets fastened laterally to the food support then form a solid unit. Alternatively, the food support may also be a frame element, to which the two holding brackets are laterally fastened. The frame element is designed in such a way that an insert, such as a baking sheet, a baking tray, a shelf, etc., can be inserted into the frame and is held by it.

The holding brackets extending rearwardly from the front portion of the food support, parallel to its side edges, are advantageously formed as bars, wires or dimensionally stable metal sheets. The connecting portions between the holding brackets and the food support are formed in a substantially U-shaped manner, the U legs respectively being formed by a holding bracket and an associated side edge of the food support. The portion connecting the U legs is advantageously a portion of the holding brackets which is bent away substantially perpendicular to the direction of the extent of the holding bracket, and advantageously ends at the front lateral corner of the food support, where the front edge and side edge of the food support meet.

In the case of one preferred embodiment of the food support according to the invention, the two holding brackets, the connecting portions for the food support and the front edge of the food support are produced from one piece, preferably a stable wire. In the case of this preferred embodiment, the food support, whether a frame element or the actual supporting surface itself, is fastened, for example by welding it on, to this portion connecting the holding brackets in one piece, and extends rearwardly in a plane with the two holding brackets.

In the case of a further preferred embodiment, the telescopic rails of the system according to the invention are conventional rails which pull out partly or fully, with a stationary rail and a movable inner rail for the fastening of the food support. One or more middle rails may be provided between the stationary rail and the inner rail, in order to increase the pulling-out length of the entire telescopic rail and/or its load-bearing strength or stability. Such telescopic rails are well known to a person skilled in the art in a wide variety of forms. The individual rails of such telescopic guides are mounted displaceably with respect to one another by cage-mounted balls, rollers, rolls or simple sliding bearings and have pull-out limits, which prevent the rails from sliding completely out of one another and coming apart.

According to the invention, a receiving tube, into which the two holding brackets of the food support are pushed from the front when the food support is inserted into the oven, is fastened to the movable inner rail. The receiving tube may be formed as part of the inner rail profile. However, to allow commercially available, conventional rail elements to be used for the system according to the invention, it is advantageous if the receiving tube is subsequently fastened solidly or releasably to the inner rail. A solid connection may take place by welding, riveting or the like. Examples of a releasable connection are screw connections, hooking-in or clamping connections. The receiving tube may comprise a metal tube or a bent metal sheet. In the case of a particularly preferred embodiment of the invention, the receiving tube is formed by a cross sectionally substantially U-shaped, elongate sheet metal profile, in which the ends of the U legs are fastened to the inner rail by welding. It is particularly advantageous if the U-shaped profile is rectangular or square in cross section.

In the case of the system according to the invention, a hook and a catch are provided on the holding bracket and the receiving tube, by which the holding bracket and receiving tube can be releasably brought into engagement with each other, preventing the holding bracket from being pulled out of the receiving tube. In the case of a preferred embodiment of the invention, the hook is formed on the holding bracket and the catch is formed on the receiving tube in the form of a recess or opening. The recess or opening on the receiving tube is located on the downwardly facing side of the receiving tube, and the hook on the holding bracket is likewise directed downwardly and designed in such a way that it engages in this recess or opening when the food support is fully pushed inwardly. As a result of gravity, the holding brackets are resting on the lower inner wall of the receiving tube. If the food support, laden with food, for example, is pulled out horizontally from the oven with the holding brackets hooked in, the engagement of the hook and catch ensures that the holding brackets are not pulled out again from the receiving tube, but instead the sliding of the food support out of the oven over the telescopic rails takes place by taking the inner rail along with it (and if appropriate one or more middle rails). In this way, the food support is pulled partly or fully out of the oven muffle for inspecting the food and performing anything necessary to it. The food support sits stably, and without being able to tip, on the telescopic rails. If the food support is to be removed completely from the oven, the engagement between the hook and, catch on the holding bracket and receiving tube is released by slightly raising the food support and pulling the holding brackets out of the receiving tube. The system is simple and, in particular with respect to the food support with the holding brackets, can be produced very inexpensively.

In the case of a preferred embodiment of the invention, the hook is formed as a bent portion, a number of times of an otherwise substantially straight holding bracket. Alternatively, the hook may also be welded onto the holding bracket or attached in any other manner which is easy for a person skilled in the art.

In the case of a further alternative embodiment, the catch comprises an upwardly directed bend in the holding bracket and the hook is formed as an upwardly projecting elevation on the lower inner wall of the receiving tube. When the food support is inserted, the holding brackets are guided over the elevation in the receiving tube and lowered to bring them into engagement, as soon as the bend on the holding bracket lies above the elevation in the receiving tube.

In the case of a particularly preferred embodiment of the rail system according to the invention, the telescopic rails and the receiving tube are arranged outside the oven muffle, expediently between the muffle side walls and the oven outer walls. This has several advantages. The entire rail system is arranged outside the oven muffle and consequently separated from the cooking space by the muffle side walls. As a result, soiling of the telescopic rails and of the receiving tube by food, spattering or evaporating fat or other liquids is avoided substantially completely. In addition, the rail system lies in a region of the oven which is heated much less during operation of the oven than the actual cooking space in the muffle. In addition, heat insulation may also be provided between the rail system and the muffle side walls. This has the advantage that the holding brackets of the food support heat up much less than the food support itself, and therefore, when the food support is being removed from the oven, can already be grasped immediately or after a considerably shorter cooling time. In addition, lubricating and sliding agents in the telescopic rails are heated considerably less than if the telescopic rails were arranged inside the oven muffle. This allows the use of other lubricating or sliding agents than would be required for higher temperatures, such as prevailing in the cooking space of the oven. This increases the selection of the lubricating or sliding agents which can be used, and these agents can be selected against the background of costs, suitability for food contact applications, toxicity, etc. Only a relatively select few lubricating or sliding agents are resistant to higher temperatures, and also suitable and authorized for use in connection with the preparation of food. They are often very expensive.

In the case of an alternative embodiment of the invention, the rail system is attached to the muffle side walls in the space inside the muffle. In this case, it is expedient if the telescopic rails and the receiving tube are covered, to prevent soiling and/or excessive heating, with respect to the remaining cooking space. Such a covering may be formed, for example, as a metal sheet which extends from the muffle side wall over the telescopic rails and the receiving tube again up to the muffle side wall. In the muffle, there may also be provided an intermediate wall which is arranged in front of the muffle side wall and the rail system and extends from the upper muffle wall to the lower muffle wall in order simultaneously to protect a number of rail systems arranged one above the other on the muffle inner wall.

According to the invention, it is particularly expedient if the front opening of the receiving tube is greater by an adequate amount than the diameter of the holding brackets, in order to make the insertion of the ends of the holding brackets into the two openings of the two receiving tubes on one level of the oven as simple as possible. In the case of a receiving tube, which for production reasons, expediently has the same cross section throughout, the holding bracket therefore has, on account of its smaller diameter, a clearance in the receiving tube and can move about and vibrate. To counteract this, in the case of a particularly preferred embodiment of the invention, the receiving tube has in the rear region, facing the rear side of the oven, a tongue extending into the interior of the receiving tube, or a projection which reduces the clearance of the holding bracket inside the receiving tube. In the case of a receiving tube formed as a bent metal sheet or profile, this can be realized in a particularly advantageous and low-cost way by, for example, making a substantially U-shaped incision on the upper wall of the receiving tube and bending the tongue produced by the incision into the space inside the receiving tube. In this case, the free end of the tongue should be directed toward the rear wall of the oven, so that the bent-in tongue offers on its inner side with respect to the tube a sliding or guiding surface for the holding bracket when the latter is inserted. Instead of a tongue, however, a stamped piece protruding into the interior of the receiving tube or an elevation provided, for example, by welding on the inner wall surface of the receiving tube, may also be provided for reducing the clearance.

In the case of an alternative embodiment, which likewise reduces the clearance of the holding bracket inside the receiving tube, the cross section of the receiving tube narrows from the front region in which the opening for inserting the holding bracket is located, toward the rear region in the direction of the rear wall of the oven.

In the case of a further preferred embodiment of the invention, a locking bolt is provided on the receiving tube, preventing the food support from being raised when the holding bracket has been pushed into the receiving tube and the hook and catch on the holding bracket and receiving tube are in engagement with each other. Such locking prevents the food support or the holding brackets from being inadvertently pulled out of the receiving tubes when the food support is unintentionally raised, if actually intended only for the food support to be pulled over the telescopic rails to bring it in front of the oven muffle. Such a locking mechanism may comprise a locking bolt which is simply hinge-mounted on the wall of the receiving tube. Advantageously, it has catch positions in an open and/or closed, i.e. locked, position.

Further advantages, features and exemplary embodiments become clear from the description which follows of the accompanying figures.

DESCRIPTION OF THE PREFERRED EMBODIMENTS

Figures 1, 2:
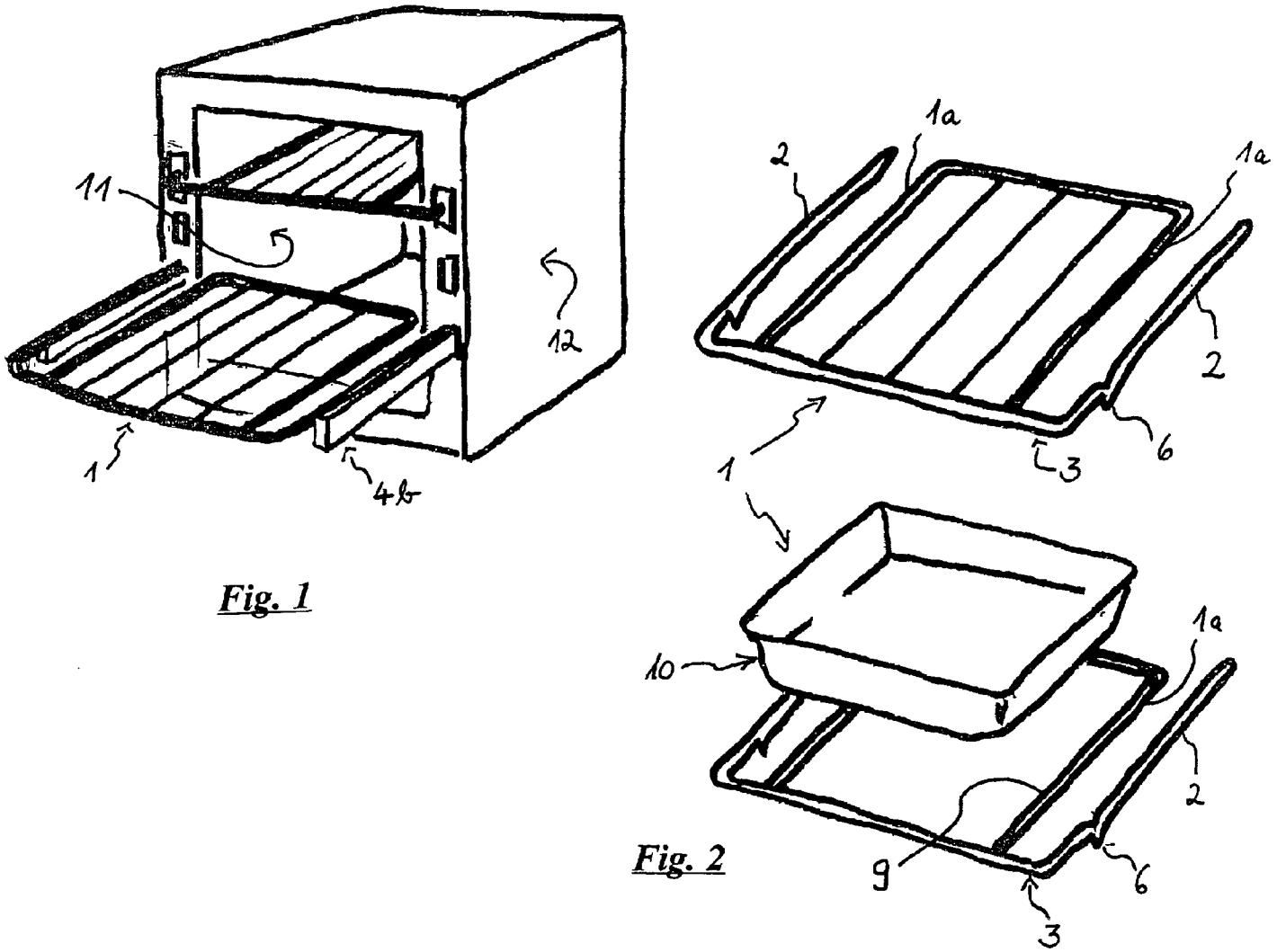
FIG. 1 shows a baking oven with a rail system according to the invention and corresponding food supports.
FIG. 2 shows two different embodiments of food supports according to the invention.

FIG. 1 shows a baking oven, in which the rail system according to the invention is provided between the muffle side walls 11 and the oven outer walls 12 on three levels lying one above the other. As a result, the rail system is completely separated from the actual cooking space in the muffle and protected against soiling and excessive heating. Also represented in FIG. 1 are two food supports 1, of which the upper one has been pushed into the oven and the lower one has been pulled out. The food supports from FIG. 1, which are shown once again in the upper representation of FIG. 2, comprise a grid-like shelf as the actual food support and holding brackets 2 which laterally extend parallel to the side edges la of the food support and are connected in the front portion of the food support to the latter by means of connecting portions 3 formed in a U-shaped manner. The food supports are provided with downwardly pointing hooks for bringing them into engagement with a catch of the rail system.

The lower representation in FIG. 2 shows an alternative embodiment of the food support 1 according to the invention, which differs from the embodiment represented at the top in FIG. 2 by the fact that the food support 1 has a holding frame 9 with side edges 1*a*, into which a baking tray 10 can be fitted.

Figure 3:
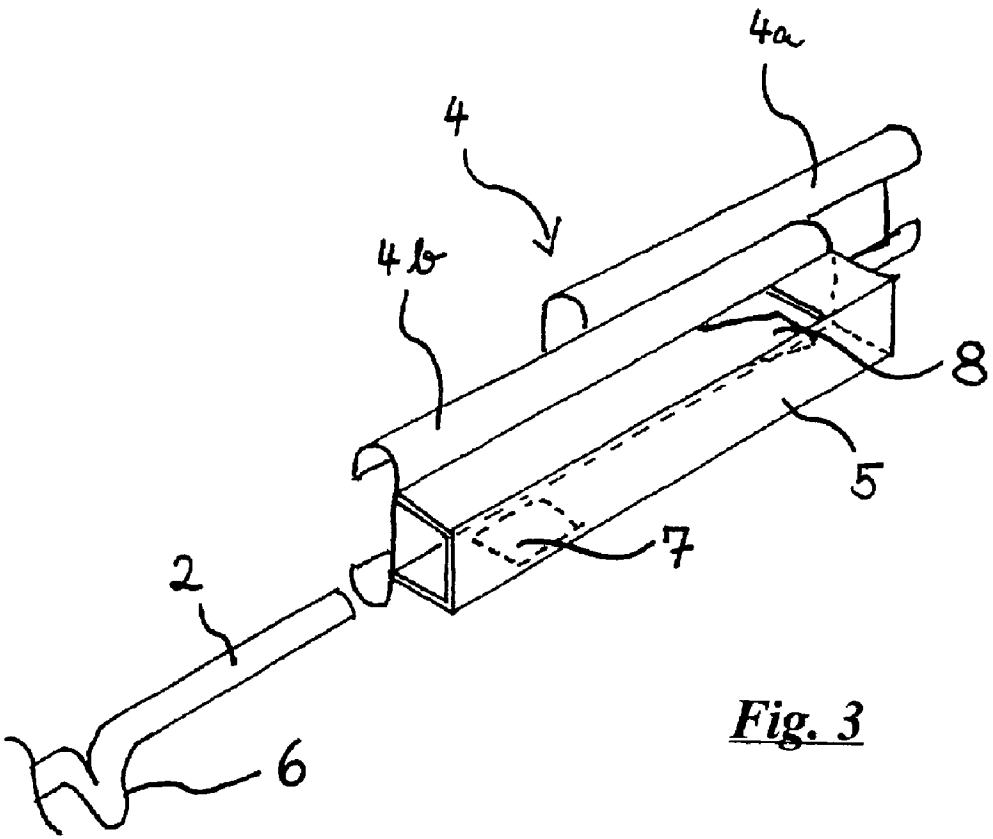
FIG. 3 shows a perspective view of a detail of the rail system according to the invention for food supports.

FIG. 3 shows a view of a detail of the rail system according to the invention for food supports. Represented is a telescopic rail 4 for the mounting of the system on the left-hand side of a baking oven, when viewing the oven from the front. The telescopic rail 4 comprises two rail elements, a stationary rail 4*a* and a rail 4*b* which is displaceable in relation to the stationary rail 4*a*. The stationary rail 4*a* is fastened to the muffle side wall or between the muffle side wall 10 and the oven outer wall, as represented in FIG. 1, by screwing, hooking-in or some other known way. Fastened to the movable rail 4*b* toward the interior of the oven is a receiving tube 5. In the case of this embodiment, the receiving tube comprises a sheet-metal profile with an angular, substantially U-shaped cross section. The free ends of the U legs of the profile are fastened to the outer side of the C-shaped displaceable rail 4*b*. The fastening may take place by welding, screwing or any other suitable method. Alternatively, a profile 20 formed with a square or rectangular cross section and four sides may also be used, with one side bearing against the rear side of the displaceable rail 4*b* and serving as a fastening surface.

The receiving tube 5 has a catch, formed as an opening in the lower wall surface, for bringing it into engagement with the hook 6 of the holding bracket 2 on the food support. In FIG. 3, the holding bracket 2 of the food support is shown broken-off. The holding 30 bracket 2 is formed as a straight wire or bar, with the hook 6 being a bend of the wire or bar in a downwardly pointing direction.

In the vicinity of the rear end, facing the rear side of the oven, the receiving tube 5 has a tongue 8 provided in the upper wall. The tongue 8 is produced by cutting into the material of the wall and bending it away toward the space inside the receiving tube 5. The free end of the tongue 8 points in the direction of the rear side of the oven, so that the tongue 8 on the one hand reduces the clearance of the holding bracket 2 in the receiving tube 5 in this region, or prevents it substantially entirely, and on the other hand also 5 forms at the same time a guiding surface on which the holding bracket can slide along when it is inserted into the receiving tube 5. The tongue, as an element with a certain resilience, can advantageously protrude so far into the space inside the receiving tube that it presses the pushed-in holding bracket against the inner wall of the receiving tube with resilient prestressing and consequently completely prevents any clearance of the holding bracket in this portion of the receiving tube.

When the food support is inserted into the oven, i.e. the holding bracket 2 is inserted into the receiving tube 5, the hook 6 on the holding bracket 2 enters the opening or catch 7 when the food support is lowered or set down. If the food support is then pulled out of the oven in a horizontal direction, the sliding of the food support over the telescopic rail 4 takes place, in that the movable rail 4*b* is taken along with it on account of the arresting of the holding bracket 2 and receiving tube 5 by the hook 6 and catch 7.

Figure 4:
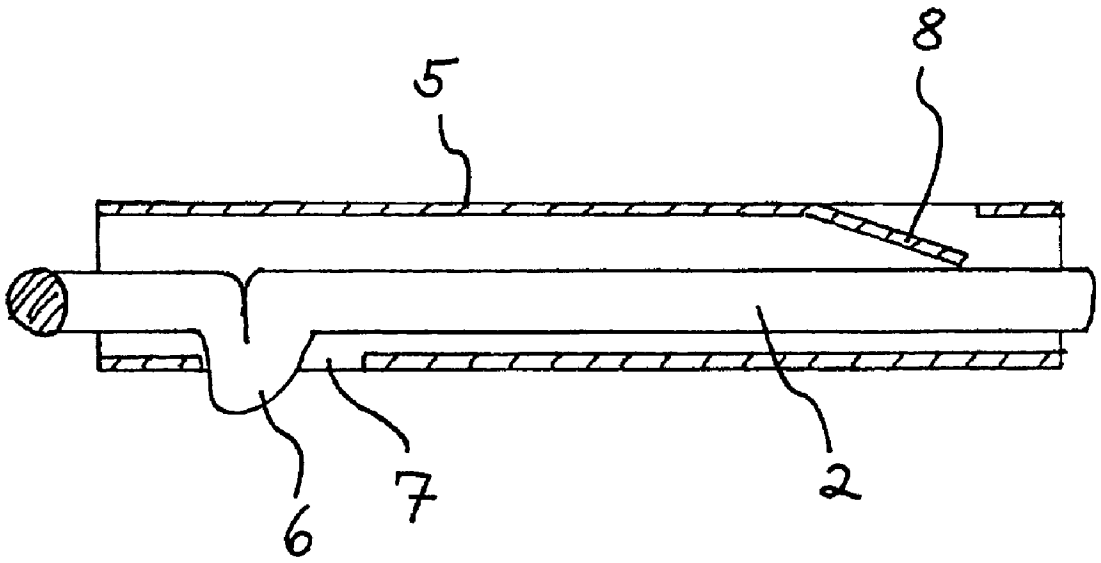
FIG. 4 shows a receiving tube according to the invention with a pushed-in holding bracket in cross section.

FIG. 4 shows the receiving tube 5 from FIG. 3 with the inserted holding bracket 2 in cross section. The tongue 8 on the receiving tube 5 has been bent downward to such an extent that the holding bracket 2 has only slight clearance in the receiving tube 5.

On the receiving tube according to FIGS. 3 and 4 there may also be provided above the catch 7 and hook 6 a locking device (not represented), which holds the holding bracket 2 down in a locked position in the region of the hook 6 or else in front or behind it, so that the arresting of the holding bracket 2 and receiving tube 5 in the horizontal direction cannot be released by raising the holding bracket 2.

We claim:

1. A rail system for food supports in a baking oven, which comprises:

(i) a food support with first and second side sections, a front portion, holding brackets substantially parallel to said first and second side sections of said food support and a connecting portion between said holding brackets engaging with the front portion of the food support forming a substantially U-shaped configuration, and (ii) telescopic rails each comprising a stationary rail for fastening to or behind the side wall of an oven muffle, a displaceable inner rail movable relative to said stationary rail into and out from said oven, and a receiving tube adjacent to said displaceable inner rail, said receiving tube adapted for receiving and engaging with a holding bracket of said food support.

2. The rail system according to claim 1, wherein said holding brackets are spaced from the first and second side sections of said food support and the food support is suspended as a cantilever.

3. The rail system according to claim 2 wherein the telescopic rails are disposed outside the oven muffle.

4. The rail system according to claim 3 wherein the telescopic rails are arranged between the muffle side walls and outer walls of said oven.

5. The rail system according to claim 1, wherein the receiving tube of said telescopic rail extends substantially over the length of the inner rail forming a unit with said inner rail.

6. The rail system according to claim 1, wherein said receiving tube comprises an opening adapted for introducing the holding bracket therein.

7. The rail system according to claim 6 wherein the holding bracket and receiving tube comprise means for releasable engagement of said holding bracket from said receiving tube.

8. The rail system according to claim 7 wherein said holding bracket and receiving tube comprise a hook and a catch for bringing said holding bracket and receiving tube into releasable engagement.

9. The rail system according to claim 8, wherein said hook is formed on the holding bracket, and said catch, is formed on the receiving tube in the form of a recess or opening.

10. The rail system according to claim 1, wherein the food support comprises a member selected from the group consisting of a baking sheet, a baking shelf, a baking pan and a baking tray.

11. The rail system according to claim 1 wherein the food support comprises means for supporting food in an oven and the holding brackets fastened laterally to said means for supporting food form an integral unit.

12. The rail system according to claim 1 wherein the telescopic rails comprises one or more middle rails disposed between the stationary rail and the displaceable inner rail.

13. The rail system according to claim 8 wherein said hook comprises a plurality of bends or folds in said holding brackets.

14. The rail system according to claim 1, wherein said receiving tube of the telescopic rail comprises a rear region in proximity to the backside of the oven, and a tongue extending into an interior region of said tube reducing the clearance in said interior region for said holding bracket.

15. The rail system according to claim 1, wherein said food support comprises a holding frame for receiving and supporting a member selected from the group consisting of a baking sheet, a baking tray, a baking pan and a baking shelf.

16. A food support for a baking oven comprising a food support with first and second side sections, a front portion, and holding brackets connected to said front portion of said food support by means of a substantially U-shaped connecting portion extending so said holding brackets are substantially parallel to said first and second side sections of said food support, said holding brackets comprising a hook adapted to engage with mounting rails of said oven.

17. The food support according to claim 16, wherein the food support comprises a resting surface for cooking utensil, or a supporting frame for receiving an oven utensil.

18. The food support according to claim 16 wherein said mounting rails of said baking oven are telescoping rails.

19. The food support according to claim 18, wherein said holding brackets adapted to engage with said telescoping rails are mounted outside interior walls of an oven muffle.

* * * * *